United States Patent [19]

Giordano et al.

[11] 4,272,916

[45] Jun. 16, 1981

[54] PROXIMITY RESPONSIVE TOY

[75] Inventors: George P. Giordano; Robert E. Cordrey; Allen F. Eberts, all of Cincinnati, Ohio

[73] Assignee: CPG Products Corp., Cincinnati, Ohio

[21] Appl. No.: 100,986

[22] Filed: Dec. 6, 1979

[51] Int. Cl.[3] ..... A63H 30/02

[52] U.S. Cl. ..... 46/253; 46/264

[58] Field of Search ..... 46/233, 253, 264, 265, 46/266, 256; 346/695; 273/145 A

[56] References Cited

U.S. PATENT DOCUMENTS

| | | | |
|---|---|---|---|
| 3,350,098 | 10/1967 | Cromp et al. | 273/145 A |
| 3,559,336 | 2/1971 | Nozaki | 46/266 |
| 3,893,121 | 7/1975 | Ringer | 340/695 |

FOREIGN PATENT DOCUMENTS

| | | | |
|---|---|---|---|
| 2238014 | 2/1974 | Fed. Rep. of Germany | 46/233 |

*Primary Examiner*—F. Barry Shay

*Attorney, Agent, or Firm*—Bacon & Thomas

[57] ABSTRACT

A wheel-supported figure toy in the form of a pup has a driving motor to propel it in a forward direction. Proximity sensors in the form of capacitor plates control operation of the motor. When a child's hand or the like approaches the rear of the figure, the capacitance of a first capacitor arrangement is changed and the motor is started and propels the figure forwardly for a predetermined time, then stops. If the hand is placed under the pup's chin, a second capacitor arrangement causes the pup to follow the hand. An RC network determines the time the motor is in operation by holding a monostable vibrator on, which keeps the motor running, after it is started, for the predetermined time interval. The toy also has a sounding device that operates when the figure is being propelled.

8 Claims, 5 Drawing Figures

PROXIMITY RESPONSIVE TOY

BACKGROUND OF THE INVENTION

This invention is in the field of motor propelled figure toys.

Many motor propelled figure toys have been proposed heretofore, and particular attention is directed to the patent to Nozaki, U.S. Pat. No. 3,559,336. That patent describes a figure toy in the form of a pup having a driving motor therein which when actuated causes the simulated pup to seemingly walk forwardly. When the device is turned on the pup starts moving forwardly, but when it approaches another object such as a human operator, a proximity sensing arrangement deenergizes the motor and the figure toy stops moving. At that time the figure starts to make noise or move its ears or the like, while stopped in its forward motion.

SUMMARY OF THE INVENTION

The present invention contemplates a figure toy such, for example, as a toy dog having ground wheels and a motor to drive the dog in a forward direction. Electrical controls include a proximity sensing arrangement so that as a child's hand approaches the rear of the dog, it will initiate operation of the motor to drive the dog forwardly, and it will stop after a predetermined length of time. In addition, a further proximity sensing device at the dog's chin permits the child to place his hand under the dog's chin and close thereto, and the figure will then follow the hand in a forward direction. In addition, sounding means are provided to produce sounds as the toy is moving forward.

The proximity sensing device is in the nature of a capacitor plate having a capacity relative to ground which is altered when the operator or child's hand approaches the plate and thus initiates operation of an electronic circuit, to be described, to effect starting of the motor. While the following description relates specifically to a toy dog, it is to be understood that the principles of the invention may be applied to other figure toys to initiate and/or terminate other operations simulating body functions. For example, the proximity sensing device could be used in a doll to initiate operation of a phonograph or the like to simulate speech.

DESCRIPTION OF A PREFERRED EMBODIMENT

Figure 1:
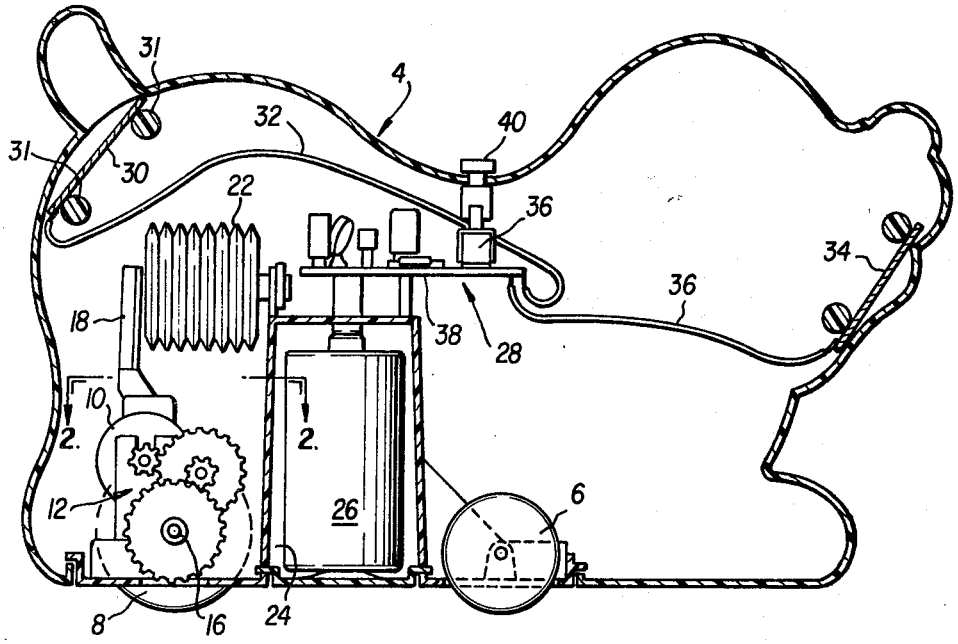
FIG. 1 is a longitudinal sectional view through a representative figure toy embodying the present invention.
Figure 2:
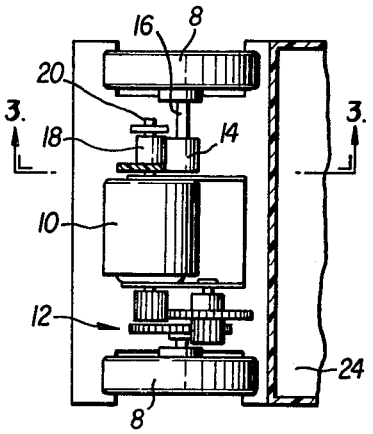
FIG. 2 is a fragmentary sectional view taken line 2—2 of FIG. 1.
Figure 3:
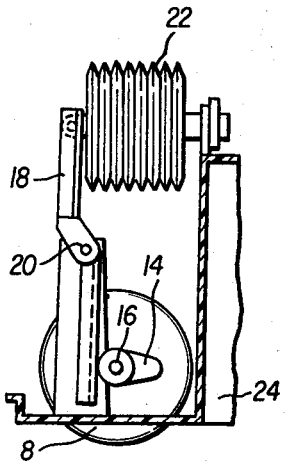
FIG. 3 is a sectional view taken along the line 3—3 of FIG. 2.

In FIG. 1, numeral 4 designates generally a hollow body configured to represent a pup or the like. The body is supported by ground wheels 6 and 8 and the ground wheels 8 are driven by a motor 10 through suitable reduction gearing 12. The details of the gearing will not be described since the same are conventional. When the motor 10 is energized and the figure is moving forwardly, a cam 14 (FIG. 3) on the drive axle 16 periodically engages a lever 18 pivoted at 20 to compress and release a sound producing bellows device 22. A battery compartment 24 houses batteries 26 to supply power to the motor 10 and (not shown) a further battery to energize and provide power for an electronic circuit designated generally numeral 28. Numeral 30 designates a capacitor plate mounted within the body 4, held in place by bars 31, and connected by a conductor 32 to the electronic circuit 28. As shown, the plate 30 is mounted at the rear of the body 4. A second capacitor plate 34 is similarly mounted in the body in a region corresponding to the chin portion of the FIG. 4 and is connected by conductor 36 to the electronic circuit 28. An on/off switch 36 is mounted on the electronic circuit board 38, and is actuable by a suitable button or manually operable slide member 40 accessible from the outside of the figure.

Figure 4:
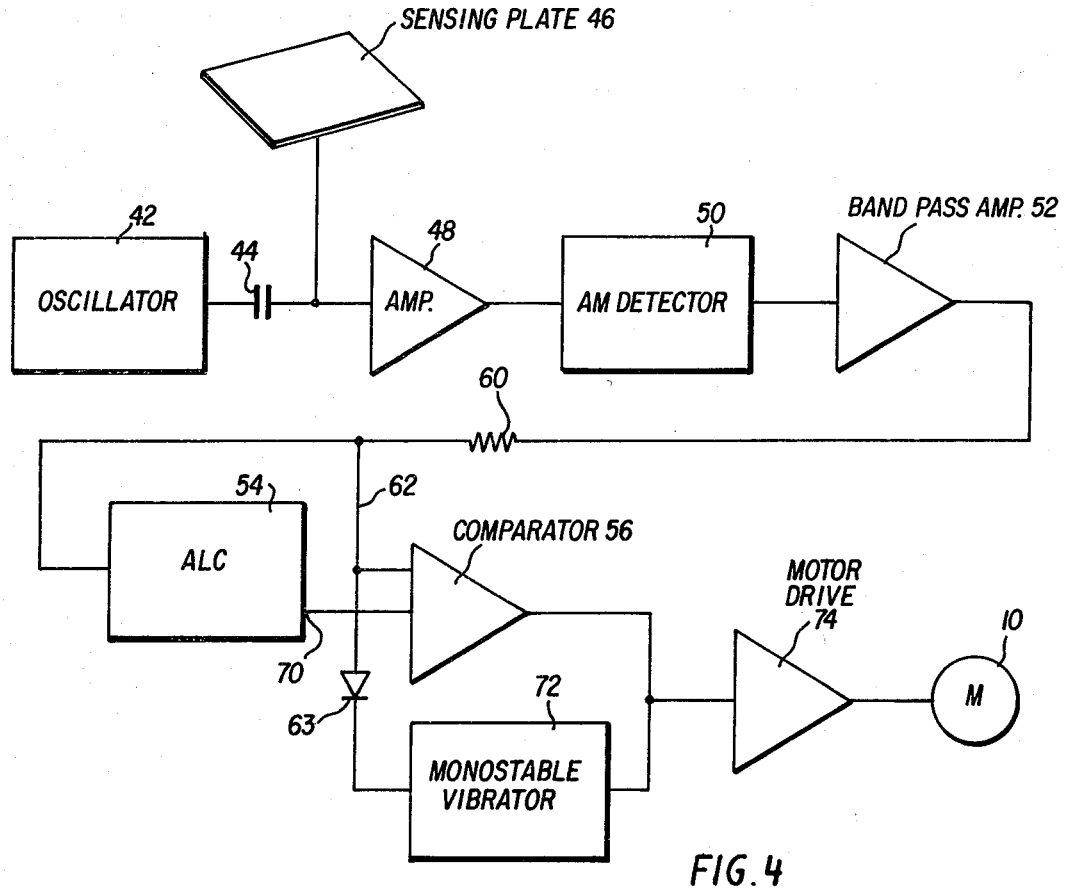
FIG. 4 is a block diagram of the electrical circuitry employed in the device.

Referring now to FIG. 4, numeral 42 designates a high frequency oscillator, the output of which is fed to a capacitive voltage divider comprising capacitor 44 in series with the output of oscillator 42 and a proximity sensing capacitor plate 46, which may be the plate 30 of FIG. 1 or the plate 34 of that figure. The sensor plate 46 acts as a variable capacitance to ground. As a hand, conductive or dielectric body approaches the sensor plate 46, the effective capacitance of the capacitor increases. This increase causes a decrease in the AC voltage appearing at the node common to the series capacitor 44 and the sensor plate. The varying signal from the above is then passed through an amplifier stage 48, and is then applied to an amplitude modulation detector 50. The output of the amplitude modulation detector is a varying DC signal voltage that is inversely proportional to the change in capacitance of the sensor plate 46. The signal from the detector is amplified and filtered at 52 and serves to drive an automatic level control circuit 54 and comparator stage 56 through resistor 60. This automatic level control circuit produces a reference voltage which is supplied to the comparator stage 56 and to the monostable vibrator 72 through diode 63.

Figure 5:
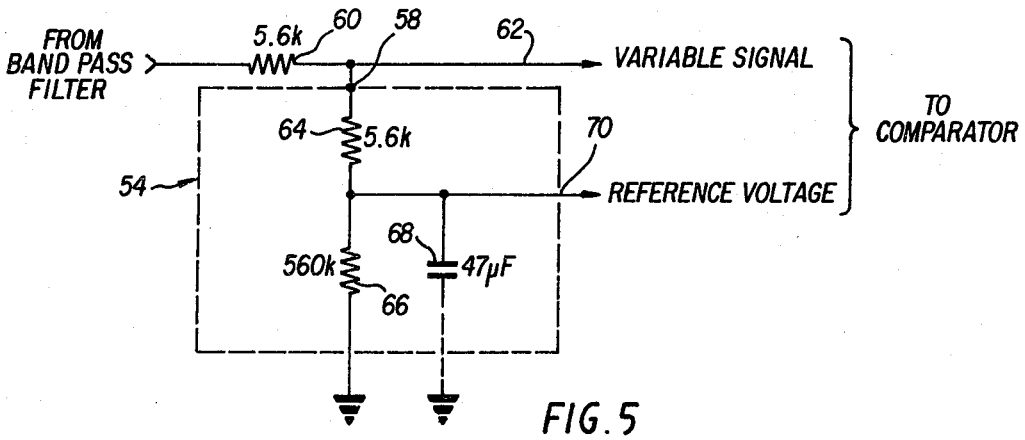
FIG. 5 is a schematic view of the circuit in one of the blocks of FIG. 4.

FIG. 5 is a schematic view of the circuitry of the automatic level control 54. As shown, the signal from band pass amplifier 52 is fed into the automatic level control at 58 having passed through resistor 60, and through conductor 62 to the comparator as a variable signal. The automatic level control, following resistor 60 comprises a voltage divider, to ground, comprising resistors 64 and 66. At the juncture between the resistors 64 and 66, a capacitor 68 leads to ground and thus defines, with resistor 66 an RC timing circuit, the output of which is fed to output terminal 70.

The output at terminal 70 constitutes a reference voltage which is established by the resistors 64 and 66 and capacitor 68, the time constant for which is long when compared to the incoming frequency components of the signal from the band pass amplifier 52. The signals from 62 and 70 are fed to comparator 56 and when a predetermined difference between those signals exists, the output voltage which is normally positive with respect to the reference goes negative, causing the comparator to change state. When the comparator changes state, the monostable multivibrator 72 is triggered and holds the comparator circuit in the triggered state until the timing circuit has discharged. While in the triggered state, the comparator drives the output transistor 74 to drive the motor of the toy.

As will be apparent, if the switch 40 is in the "on" position and the child's hand approaches the capacitor plate 30, the motor 10 will be started and the toy will be propelled to forwardly as though the pup were frightened and sought to escape the oncoming hand. After a predetermined period of time, when the capacitor plate 30 has pulled away from the child's hand, the timing circuit described with respect to FIG. 5 effects stopping of the motor 10 and the pup then stops and the cycle may be repeated.

If the child places his hand under the figure's chin, the capacitance of the plate 34 is altered and the functions occur, but in this instance the plate keeps approaching the child's hand, and the sensing circuit is continuously triggered as the figure toy momentarily stops and thus the child's hand may be withdrawn from the sensor. Thus, the driven toy will follow the child's hand as long as desired.

While a single specific embodiment of the invention has been shown and described, the same is merely illustrative of the principles involved, and obviously other figures and other types of body function, other than forward progress, may be achieved by the described circuitry.

We claim:

1. A toy having motor-driven drive means for propelling the same, electrical sensing circuit means on said toy, including a capacitor plate means for sensing the proximity of said toy to a capacitive body;

and control circuit means responsive to a predetermined change in capacitance of said sensing circuit means upon close proximity of said capacitive body to said capacitor plate means for initiating operation of said motor for a predetermined period of time;

said drive means being arranged to drive said toy in a forward direction, said capacitor plate means including a plate positioned in a rear region of said toy whereby approach of a capacitive body to said rear region will cause said toy to move in a direction away therefrom; and p1 a further plate positioned in a forward region of said toy whereby approach of a capacitive body thereto will cause said toy to move toward said latter capacitive body and follow any forward movement thereof.

2. A toy as defined in claim 1 wherein said toy simulates an ambulatory animal and said motor drives said toy in a manner to simulate the body function of locomotion.

3. A toy as defined in claim 1 whereby said sensing circuit means includes a capacitive voltage divider providing an input signal to said control circuit means.

4. A toy as defined in claim 1 wherein said control circuit means includes an RC network providing a timing circuit for terminating operating of said motor after said predetermined period of time.

5. A toy as defined in claim 1 including sound producing means operable by said motor during driven movement of said toy.

6. A toy as defined in claim 1 wherein said control circuit means comprises:

an automatic level control circuit arranged to receive, at its input, a voltage signal from said sensing circuit means and having a first output for said voltage signal and a second output for a reference voltage generated by said voltage signal; and means for directing signals from said first and second outputs to a comparator, said comparator controlling operation of said motor.

7. A toy as defined in claim 6 including a monostable vibrator having its input connected to the output of said comparator and its output connected to said comparator to maintain said motor in operation.

8. A toy as defined in claim 7 wherein said automatic level control circuit includes an RC network for generating said reference voltage.

* * * * *